US006042445A

United States Patent [19]

Amrine et al.

[11] Patent Number: 6,042,445

[45] Date of Patent: Mar. 28, 2000

[54] METHOD FOR AFFIXING SPACERS IN A FIELD EMISSION DISPLAY

[75] Inventors: Craig Amrine, Tempe; Curtis D. Moyer, Phoenix, both of Ariz.

[73] Assignee: Motorola, Inc., Schaumburg, Ill.

[21] Appl. No.: 09/334,568

[22] Filed: Jun. 21, 1999

[51] Int. Cl.[7] ..... H01J 9/24

[52] U.S. Cl. ..... 445/24; 219/121.64

[58] Field of Search ..... 445/24, 25; 219/121.64, 219/121.14

[56] References Cited

U.S. PATENT DOCUMENTS 4,782,209 11/1988 Caers et al. ..... 219/121.64
5,272,413 12/1993 Yamazaki et al. ..... 313/495
5,561,343 10/1996 Lowe ..... 445/24
5,811,927 9/1998 Anderson et al. ..... 313/495
5,851,133 12/1998 Hofmann ..... 445/24

*Primary Examiner*—Kenneth J. Ramsey
*Attorney, Agent, or Firm*—Kevin D. Wills

[57] ABSTRACT

A method for affixing spacers (126, 226, 326) in a field emission display (100, 200, 300) includes the steps of: (i) providing a first display plate; providing a plurality of spacers (126, 226, 326) having first (128, 228, 328) and second opposed edges (130, 230, 330), (ii) coating first opposed edge (128, 228, 338) with a bonding layer (132, 232, 332), (iii) forming a metallic bonding pad (134, 234) on an inner surface (106, 206, 306) of first display plate, and (iv) applying a energy beam (136, 236, 336) to the bonding layer (132, 232, 332) and metallic bonding pad (134, 234), thereby forming a metallic bond.

23 Claims, 2 Drawing Sheets

METHOD FOR AFFIXING SPACERS IN A FIELD EMISSION DISPLAY

FIELD OF THE INVENTION

The present invention pertains to field emission displays and, more particularly, to a method of affixing spacers in field emission displays.

BACKGROUND OF THE INVENTION

Spacers for field emission displays are known in the art. A field emission display includes an envelope structure having an evacuated interspace region between two display plates. Electrons travel across the interspace region from a cathode plate, upon which electron emitter structures, such as Spindt tips, are fabricated, to an anode plate, which includes deposits of light-emitting materials, or "phosphors."Typically the pressure within the interspace region is less than or equal to $10^{-6}$ Torr.

The cathode plate and anode plate are thin in order to provide low display weight. These thin plates are not structurally sufficient to prevent collapse or bowing upon evacuation of the interspace region. As a result of the atmospheric pressure, spacers play an essential role in lightweight displays. Spacers are structures incorporated between the anode and the cathode plate to provide standoff. The spacers, in conjunction with the thin, lightweight, plates, support the atmospheric pressure allowing the display area to be increased with little or no increase in plate thickness.

Several schemes have been proposed for providing spacers. Some of these schemes include the affixation of structural members to the inner surface of a display plate, particularly, the anode plate. Such prior art schemes include the heating of the display plate and spacer in order to bond the spacer to the display plate. Such schemes require bonding spacers to the anode plate due to its robustness in heating and oxidizing environments compared to the cathode plate. This method has the disadvantage of spacer misalignment when contacting the cathode resulting in destruction of emitters and shorted column or row conductors. Other disadvantages to prior art schemes include large processing times required to heat display plate and spacers, oxidation of cathode metals associated with high temperatures and elaborate pick-and-place equipment required for spacer placement.

Accordingly, there exists a need for a method of affixing spacers within a field emission display that allows affixation of spacers to the cathode plate, reduces processing times, reduces spacer misalignment and eliminates the need for heating of entire display plate and spacer assembly.

BRIEF DESCRIPTION OF THE DRAWINGS

Referring to the drawings.

DETAILED DESCRIPTION

An embodiment of the invention is for a method of affixing spacers in a field emission display. The method includes providing a display plate that includes a metallic bonding pad on its inner surface, and a plurality of spacers which include a bonding layer at one end. The bonding layer of the plurality of spacers is placed in abutting engagement with the metallic bonding pad on the display plate. Subsequently, an energy beam is applied to the interface of the metallic bonding pad and bonding layer in order to join the plurality of spacers to the display plate.

The method of the invention has numerous advantages. For example, the spacer can be affixed to the display plate without heating the entire display plate and spacer assembly. This has the advantages of eliminating oxidation of components within the display, the elimination of the need to provide an inert gas atmosphere during the bonding process and reduction in the processing time needed to affix spacers. Another advantage of the method of the invention is that the spacer can be affixed to the cathode, which allows for more accurate alignment of the spacers. All of these advantages provide cost savings through increased yield and reduced processing time for fabrication of field emission displays.

Figure 1:
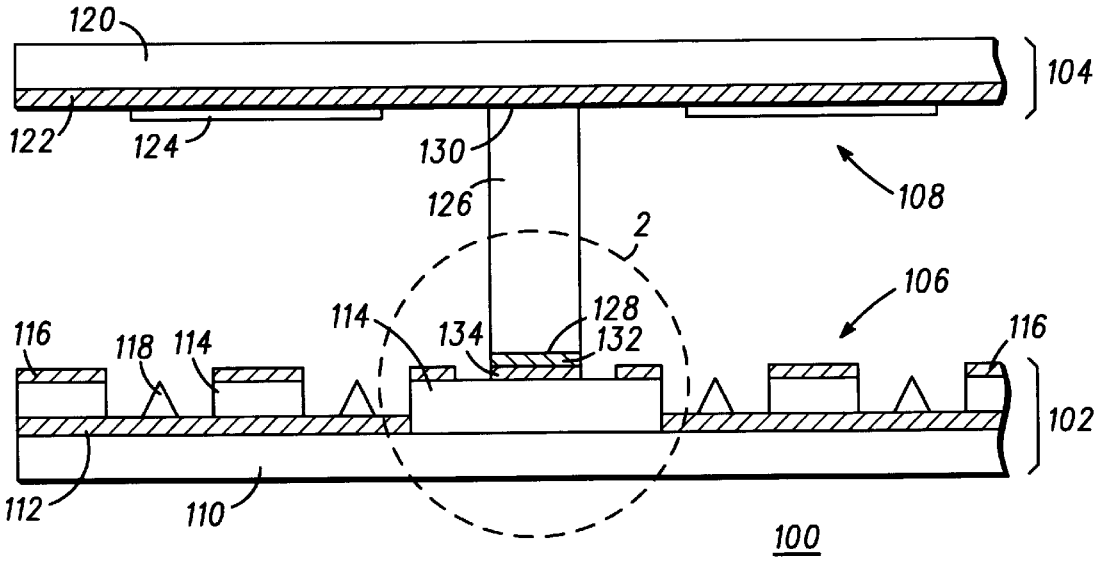
FIG. 1 is a cross-sectional view of a field emission display realized by performing various steps of an embodiment of a method of the invention.

FIG. 1 is a cross-sectional view of a field emission display (FED) 100 realized by performing various steps of an embodiment of a method of the invention. FED 100 has a cathode plate 102 with an inner surface 106, which opposes an anode plate 104 with an inner surface 108. A spacer 126 extends between cathode plate 102 and anode plate 104.

Cathode plate 102 includes a substrate 110, which can be made from glass, silicon, and the like. Upon substrate 110 is disposed a cathode 112, which can include a thin layer of molybdenum. A dielectric layer 114 is formed on cathode 112. Dielectric layer 114 can be made from, for example, silicon dioxide. Dielectric layer 114 defines a plurality of emitter wells, which contain one each a plurality of electron emitters 118. In the embodiment of FIG. 1, electron emitters 118 include Spindt tips.

However, a field emission display in accordance with the invention is not limited to Spindt tip electron sources. For example, an emissive carbon film or nanotubes can alternatively be employed for the electron source of cathode plate 102.

Cathode plate 102 further includes a plurality of gate extraction electrodes 116. In general, gate extraction electrodes 116 are used to selectively address the electron emitters 118.

Anode plate 104 includes a transparent substrate 120, upon which is formed an anode conductor 122. The anode conductor 122 can include, for example, a thin layer of indium tin oxide, a layer of a metal glass mixture, and the like. A plurality of phosphors 124 is disposed upon anode conductor 122. Electron emitters 118 selectively address phosphors 124.

Spacer 126 provides mechanical support to maintain the separation between cathode plate 102 and anode plate 104. Spacer 126 includes a first opposed edge 128 and a second opposed edge 130. One edge of spacer 126 contacts inner surface 106 of cathode plate 102 at a portion that does not define emitter wells. The opposing edge of spacer 126 contacts the inner surface 108 of anode plate at a surface that is not covered by phosphors 124. The height of spacer 126 is sufficient to aid in the prevention of electrical arcing between cathode plate 102 and anode plate 104. In one embodiment of the invention, spacers 126 can have a height in the range of 200–2000 micrometers and a width in the range of 10–250 micrometers. These dimensions depend upon the predetermined spacing between the display plates, the dimensions of the space available for spacer placement on the inner surface of display plates, and the load-bearing requirements of each spacer 126. Spacers can be made from dielectric materials, for example, ceramics, glass-ceramics, glass, quartz, and the like. Spacers can also be made from, for example, silicon nitride, transition metal oxides, and the like.

In the embodiment of the invention illustrated in FIG. 1, first opposed edge 128 of spacer 126 is coated with a metallic material to form a bonding layer 132. First opposed edges 128 of spacers 126 are coated by any number of standard deposition techniques, for example, vacuum deposition, thick film deposition, and the like. In this particular embodiment, bonding layer 132 is made from gold and is about 0.1 to 20 micrometers thick. In other embodiments of a method in accordance with the present invention, other metals such as aluminum, copper or nickel are deposited on first opposed edge 128. In still yet another embodiment, metal glass mixtures can be deposited as a bonding layer 132. The thickness of bonding layer 132 depends on the type of metallic material to which it is subsequently bonded.

In one embodiment of the invention, metallic bonding pad 134 is placed on the inner surface 106 of cathode plate at a portion that does not define emitter wells. Metallic bonding pad 134 can be part of the cathode plate 102 metalization whereby metallic bonding pad 134 is deposited by standard deposition techniques, including vacuum deposition. In this particular embodiment, metallic bonding pad 134 is made from gold and is about 0.1 to 20 micrometers thick. In other embodiments of a method in accordance with the present invention, other metals such as aluminum, copper or nickel are deposited on inner surface 106 of cathode plate 102. In still yet another embodiment, metal glass mixtures can be deposited as metallic bonding pad 134. The thickness of metallic bonding pad depends on the type of metallic material to which it is subsequently bonded.

Figure 2:
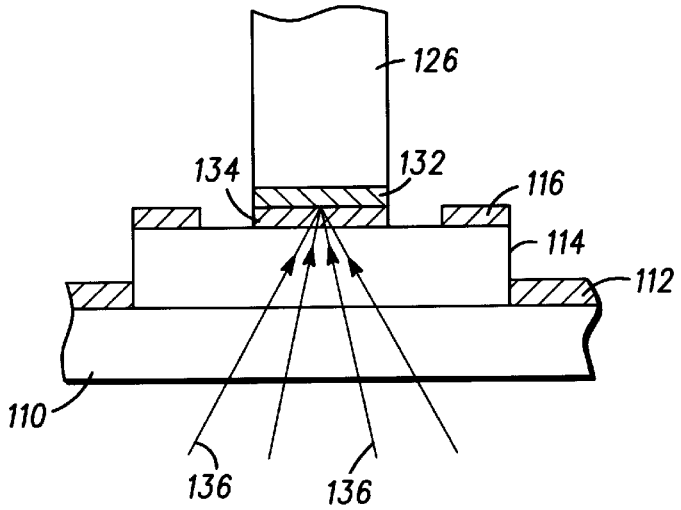
FIG. 2 is an enlarged portion of FIG. 1 taken from circled area 2 of FIG. 1 of a field emission display realized by performing various steps of an embodiment of a method of the invention.

FIG. 2 is an enlarged portion of FIG. 1 taken from circled area 2 of FIG. 1 of a field emission display realized by performing various steps of an embodiment of a method of the invention. FIG. 2 depicts placing the bonding layer 132 of spacer 126 in abutting engagement with metallic bonding pad 134 on cathode plate 102. It is important to ensure that spacer 126 is in intimate contact with metallic bonding pad 134. This can be done, for example, by creating ductile deformation in metallic bonding pad 134. Subsequently, an energy beam 136, preferably a laser beam, is applied to the interface of bonding layer 132 and metallic bonding pad 134. Applying energy beam 136 to the interface has the effect of joining bonding layer 132 to metallic bonding pad 134 to provide a plurality of affixed spacers 126. Preferably, an argon laser or a Nd-YAG laser is employed. The wavelength of energy beam 136 is selected to avoid energy beam 136 adsorption and the accompanying heating of substrate 110. Preferably, cathode plate 102 does not include cathode 112 beneath dielectric layer 114 in the area that metallic bonding pad 134 is disposed upon. This configuration is preferable to minimize interference with the energy beam 136. The pulse duration of the energy beam 136 should be chosen to avoid excessive heating at the bonding interface and is preferably within a range of 1 to 100 milliseconds. In a particular embodiment of the invention, the metallic bonding pad is composed of gold and has a thickness of 10 micrometers. The bonding layer is composed of gold and has a thickness of 1 micrometer. A Nd-YAG laser with a wavelength of 1067 nanometers is applied for a pulse duration of approximately 10 milliseconds to promote a metallic bond between metallic bonding pad 134 and bonding layer 132.

The fabrication of the field emission display 100 further includes positioning the cathode plate 102 and anode plate 104 in spaced relationship with the inner surfaces opposing each other. Subsequently, second opposed edge 130 of spacer 126 is placed in abutting engagement with anode plate 104.

However, the method of the invention is not limited to the particular embodiment described above. Metallic bonding pad thickness, energy beam type, energy beam wavelength and pulse duration can all be varied to suit particular field emission display design parameters.

Utilizing this method of spacer attachment has the benefit of eliminating the heating of the display plate and spacer assembly. Consequently, spacers can be attached to the cathode plate due to the elimination of the oxidizing environment caused by the heating of the display plate. Attaching spacers 126 to the cathode plate 102 using energy beam 136 offers the benefit of more accurate alignment of spacers because the dimensional accuracy of the bond is not affected by thermal or mechanical stresses encountered when heating the entire display plate. Elimination of the heating and cooling times inherent in the heating of the display plate and spacer assembly provides for decreased process times and increased throughput in fabrication of field emission displays.

Under certain fabrication conditions, it may be desirable to control the local environment around the bonding area. Under these circumstances, it is desirable to provide an inert or slightly reducing environment around the local bonding area. For example, surrounding the bonding layer 132 and metallic bonding pad 134 with a gas during the application of the energy beam 136 is a preferable method to achieve this environment. Hydrogen, nitrogen, and argon are examples of gases that can be applied to reduce local oxidation if necessary. However, the method of the invention is not limited to the exclusive use of the aforementioned gases. For example, mixtures of any two or three of the aforementioned gases can also be used.

Figure 3:
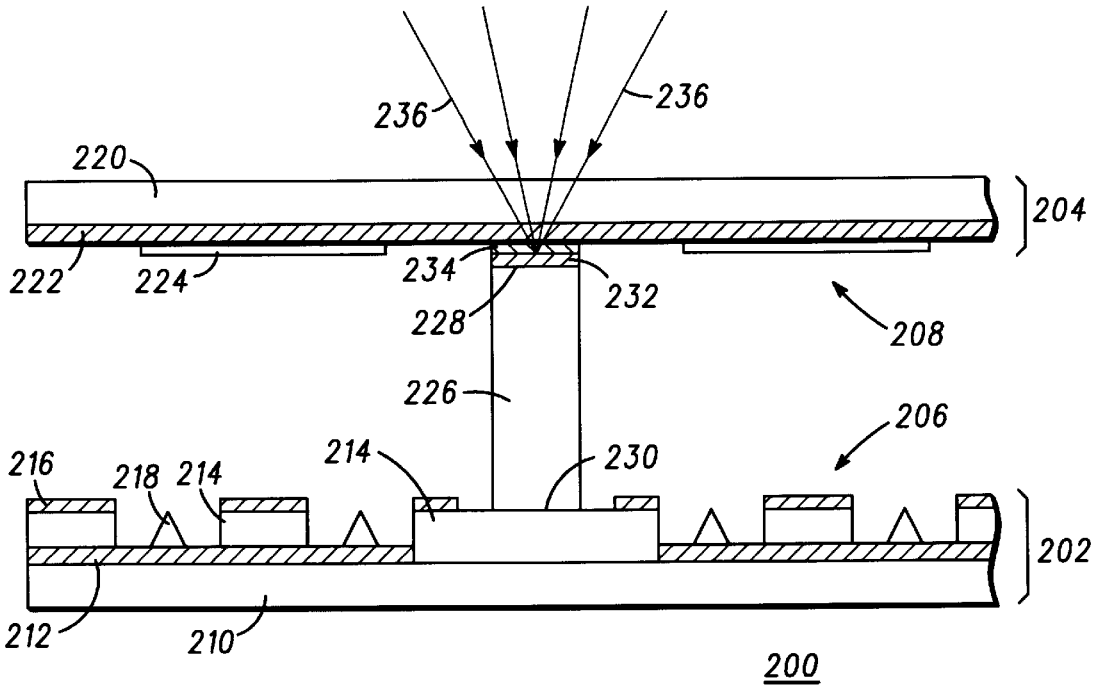
FIG. 3 is a cross-sectional view of a field emission display realized by performing various steps of another embodiment of the invention.

FIG. 3 is a cross-sectional view of a field emission display realized by performing various steps of another embodiment of the invention. FIG. 3 depicts a field emission display 200 analogous to the FED presented in FIG. 1 with designation numbers beginning with "2" instead of "1." In this embodiment of the method of the invention, spacer 226 is attached to anode plate 204. First opposed edge 228 of spacer 226 is coated with bonding layer 232 and metallic bonding pad 234 is formed on the inner surface 208 of anode plate 204. The bonding layer 232 of spacer 226 is placed in abutting engagement with metallic bonding pad 234 on anode plate 204 and an energy beam 236, preferably a laser beam, is applied to the interface of bonding layer 232 and metallic bonding pad 234 to form a metallic bond.

Figure 4:
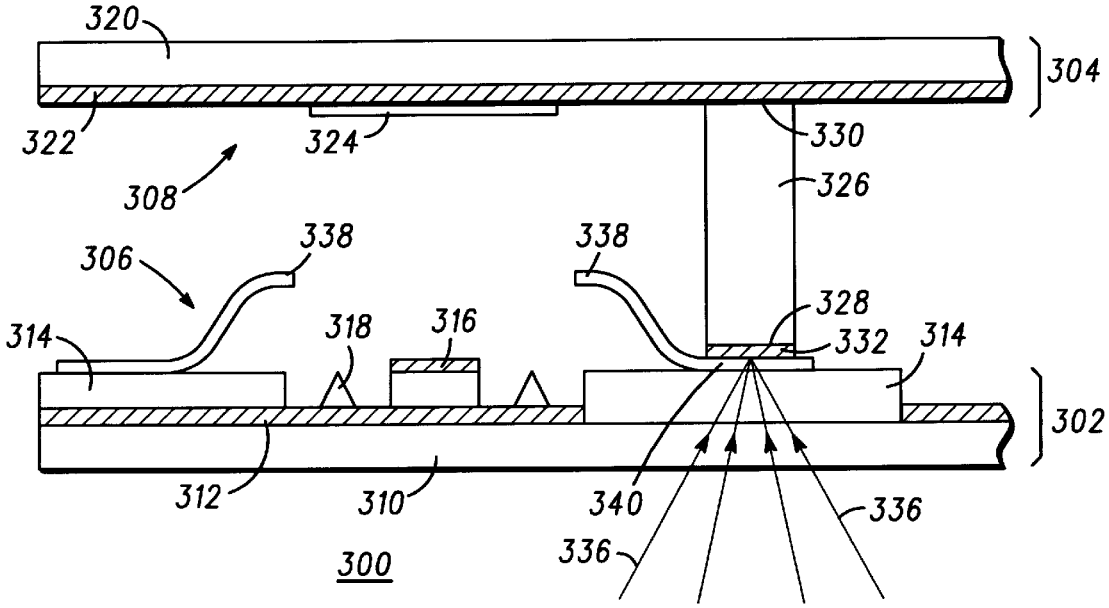
FIG. 4 is a cross-sectional view of a field emission display realized by performing various steps of yet another embodiment of the invention.

FIG. 4 is a cross-sectional view of a field emission display realized by performing various steps of yet another embodiment of the invention. FIG. 4 depicts a field emission display 300 analogous to the FED presented in FIG. 1 with designation numbers beginning with "3" instead of "1." In this embodiment of the method of the invention first opposed edge 328 of spacer 326 is attached to a focusing grid 338 which is part of the cathode plate 302. A portion of focusing grid 340 acts as the metallic bonding pad. Methods of forming focusing grids 340 are well known in the art. The bonding layer 332 of spacer 326 is placed in abutting engagement with portion of focusing grid 340 on cathode plate 302 and an energy beam 336, preferably a laser beam, is applied to the interface of bonding layer 332 and portion of focusing grid 340 to form a metallic bond. In still yet a further embodiment of the invention, focusing grid 338 can be attached to anode plate 304 with first opposed edge 328 of spacer 326 attached to focusing grid 338.

The energy beam can be applied from any direction to promote joining of spacers to a display plate. In the particular embodiment shown in FIGS. 1–4, an energy beam is applied through the display plate to the interface of bonding layer and metallic bonding pad. However, a field emission display in accordance with the invention is not limited to applying the energy beam through a display plate. For example, the energy beam can alternatively be applied from any angle or direction and be within the scope of the method of the invention.

In summary, it should now be appreciated that the present invention provides a method of affixing spacers in a field emission display. The method allows the affixation of spacers to the cathode plate, reduces processing times and spacer misalignment and eliminates the need for heating of the entire display plate and spacer assembly.

What is claimed is:

1. A method for affixing spacers in a field emission display comprising the steps of:

providing a first display plate;

providing a plurality of spacers having first and second opposed edges;

coating the first opposed edge of each of the plurality of spacers with a metallic material to provide a bonding layer;

forming a metallic bonding pad on an inner surface of the first display plate;

placing the bonding layer in abutting engagement with the metallic bonding pad; and applying an energy beam to the bonding layer and the metallic bonding pad thereby forming a metallic bond between the bonding layer and the metallic bonding pad.

2. The method for affixing spacers as claimed in claim 1, wherein the step of providing a first display plate includes the step of providing a cathode plate.

3. The method for affixing spacers as claimed in claim 1, wherein the step of providing a first display plate includes the step of providing an anode plate.

4. The method for affixing spacers as claimed in claim 1, further including the step of providing a focusing grid, wherein the focusing grid is attached to the inner surface of the first display plate and wherein a portion of the focusing grid functions as the metallic bonding pad.

5. The method for affixing spacers as claimed in claim 1, wherein the bonding layer is made from a metal selected from a group consisting of gold, aluminum, copper and nickel.

6. The method for affixing spacers as claimed in claim 1, wherein the metallic bonding pad is made from a metal selected from a group consisting of gold, aluminum, copper and nickel.

7. The method for affixing spacers as claimed in claim 1, wherein the bonding layer is formed with a thickness within a range of 0.1 to 20 micrometers.

8. The method for affixing spacers as claimed in claim 7, wherein the bonding layer is formed with a thickness within a range of 0.1 to 2 micrometers.

9. The method for affixing spacers as claimed in claim 1, wherein the metallic bonding pad is formed with a thickness within a range of 0.1 to 20 micrometers.

10. The method for affixing spacers as claimed in claim 9, wherein the metallic bonding pad is formed with a thickness within a range of 5 to 10 micrometers.

11. The method for affixing spacers as claimed in claim 1, further comprising the steps of:

providing a first display plate that includes a substrate;

providing a wavelength of the energy beam; and selecting the wavelength of the energy beam such that adsorption by the substrate is substantially avoided.

12. The method for affixing spacers as claimed in claim 1, wherein the step of applying an energy beam to the bonding layer and the metallic bonding pad further comprises the step of applying a laser beam to the bonding layer and metallic bonding pad.

13. The method for affixing spacers as claimed in claim 12, wherein the step of applying a laser beam to the bonding layer and the metallic bonding pad further comprises the step of joining the bonding layer to the metallic bonding pad to provide a plurality of affixed spacers.

14. The method for affixing spacers as claimed in claim 1, further comprising the step of applying the energy beam for a pulse duration sufficient to join the bonding layer to the metallic bonding pad.

15. The method for affixing spacers as claimed in claim 14, wherein the pulse duration is in a range of 1–100 milliseconds.

16. The method for affixing spacers as claimed in claim 14, wherein the pulse duration is in a range of 1–10milliseconds.

17. The method for affixing spacers as claimed in claim 1, further comprising the step of surrounding the bonding layer and the metallic bonding pad with a gas and wherein the gas provides a local non-oxidizing environment.

18. The method for affixing spacers as claimed in claim 17, wherein the gas is selected from a group comprising hydrogen, nitrogen and argon.

19. The method for affixing spacers as claimed in claim 17, wherein the gas is selected from a mixture of any two gases selected from the group comprising hydrogen, nitrogen and argon.

20. The method for affixing spacers as claimed in claim 17, wherein the gas is a mixture comprising hydrogen, nitrogen and argon.

21. The method for affixing spacers as claimed in claim 1, further comprising the step of providing a plurality of spacers made from a dielectric material.

22. The method for affixing spacers as claimed in claim 1, wherein each of the plurality of spacers has a width within a range of 10 to 250 micrometers and a height within a range of 200 to 2000 micrometers.

23. A method of fabricating a field emission display comprising the steps of:

providing a first and second display plate having an inner surface;

providing a plurality of spacers having first and second opposed edges;

coating the first opposed edge of each of the plurality of spacers with a metal to provide a bonding layer;

forming a metallic bonding pad on the inner surface of the first display plate;

placing the bonding layer in abutting engagement with the metallic bonding pad;

applying a energy beam to the bonding layer and the metallic bonding pad thereby forming a metallic bond between the bonding layer and the metallic bonding pad; and positioning the second display plate in parallel spaced relationship to the first display plate, the inner surface of the second display plate opposing the inner surface of the first display plate, the second opposed edges of the plurality of spacers in abutting engagement with the inner surface of the second display plate.

* * * * *